US007891328B2

(12) United States Patent
Nishida et al.

(10) Patent No.: US 7,891,328 B2
(45) Date of Patent: Feb. 22, 2011

(54) LUBRICATING SYSTEM FOR VALVE OPERATING SYSTEM

(75) Inventors: Toru Nishida, Akashi (JP); Kazuki Nagasawa, Akashi (JP); Yoshio Watanabe, Kakogawa (JP); Yoji Fukami, Kakogawa (JP); Toshiyuki Yanamoto, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 283 days.

(21) Appl. No.: 12/257,139

(22) Filed: Oct. 23, 2008

(65) Prior Publication Data

US 2009/0107435 A1 Apr. 30, 2009

(30) Foreign Application Priority Data

Oct. 25, 2007 (JP) ..... 2007-277156

(51) Int. Cl.
*F01M 1/06* (2006.01)

(52) U.S. Cl. ..... 123/90.33; 123/90.39; 123/90.16; 123/90.44; 74/569

(58) Field of Classification Search ..... 123/90.15, 123/90.16, 90.17, 90.18, 90.33, 90.34, 90.39, 123/90.44; 74/559, 567, 569
See application file for complete search history.

(56) References Cited

U.S. PATENT DOCUMENTS 7,246,578 B2 * 7/2007 Nakamura et al. ..... 123/90.16

FOREIGN PATENT DOCUMENTS

JP 2005-180232 7/2005

* cited by examiner

*Primary Examiner*—Ching Chang
(74) *Attorney, Agent, or Firm*—Alleman Hall McCoy Russell & Tuttle LLP

(57) ABSTRACT

A lubricating system for a valve operating system includes a valve operating system configured to reciprocate a valve for substantially opening and closing a port connected to a combustion chamber of an engine, and an ejecting device provided with an outlet from which a lubricating liquid is ejected. The valve operating system includes a drive cam, a driven member configured to contact the drive cam, a pivot member which is attached to the driven member and is configured to transmit movement of the driven member to the valve, and a relative position changing device configured to change relative positions of the driven member and the pivot member. The outlet of the ejecting device is oriented to face sliding surfaces of the driven member and the drive cam at least in a period which is a part of one rotation of the drive cam.

8 Claims, 9 Drawing Sheets

LUBRICATING SYSTEM FOR VALVE OPERATING SYSTEM

TECHNICAL FIELD

The present invention relates to a lubricating system for a valve operating system configured to reciprocate a valve which substantially opens and closes a port connected to a combustion chamber of an engine.

BACKGROUND ART

A variable valve timing control system in an engine is configured to change a rotational movement of a drive cam which is rotatable in association with a rotation of a crankshaft to a reciprocating movement of a valve by a pivot cam device. The variable valve timing control system is configured to change a pivot angle range of the pivot cam device to enable valve timing control according to an engine speed (see Japanese Laid-Open Patent Application Publication No. 2005-180232).

However, in such a variable valve timing control system, since a valve must be applied with a force from a spring to perform the reciprocating movement, a pressing force applied by a drive cam to another component positioned between the drive cam and the valve is large, and a sliding friction force generated on slide surfaces of the drive cam and another component, which are slidable relative to each other, is large. For this reason, the sliding surfaces tend to wear out and are low in durability.

SUMMARY OF THE INVENTION

The present invention addresses the above described condition, and an object of the present invention is to provide a valve operating system in an engine which is capable of improving durability of sliding surfaces of a pivot cam device and a drive cam.

According to the present invention, a lubricating system for a valve operating system comprises a valve operating system configured to reciprocate a valve for substantially opening and closing a port connected to a combustion chamber of an engine; and an ejecting device in which a lubricating liquid for lubricating the valve operating system flows, the ejecting device being provided with an outlet from which the lubricating liquid is ejected, wherein the valve operating system includes a drive cam configured to operate in association with rotation of a crankshaft of the engine; a driven member configured to contact the drive cam; a pivot member which is attached to the driven member and is configured to transmit movement of the driven member to the valve; and a relative position changing device configured to change relative positions of the driven member and the pivot member; wherein the outlet of the ejecting device is oriented to face sliding surfaces of the driven member and the drive cam at least in a period which is a part of one rotation of the drive cam.

In such a configuration, during the operation of the valve operating system in which the relative positions of the driven member and the pivot member are changeable, the lubricating liquid ejected from the outlet of the ejecting device is directly applied to the sliding surfaces of the driven member and the drive cam. As a result, the lubricating liquid is sufficiently fed to the sliding surfaces of the driven member and the drive cam so that an oil film thickness on the sliding surfaces is stably maintained. This enables improvement of durability against wear out of the valve operating system. It should be noted that the sliding surfaces are contact surfaces of the driven member and the drive cam which are slidable relative to each other, and it suffices that the lubricating liquid ejected from the outlet of the ejecting device is applied to at least one of the sliding surfaces of the driven member and the drive cam.

DETAILED DESCRIPTION OF THE PREFERRED EMBODIMENTS

Hereinafter, an embodiment of the present invention will be described with reference to the accompanying drawings.

Figure 1:
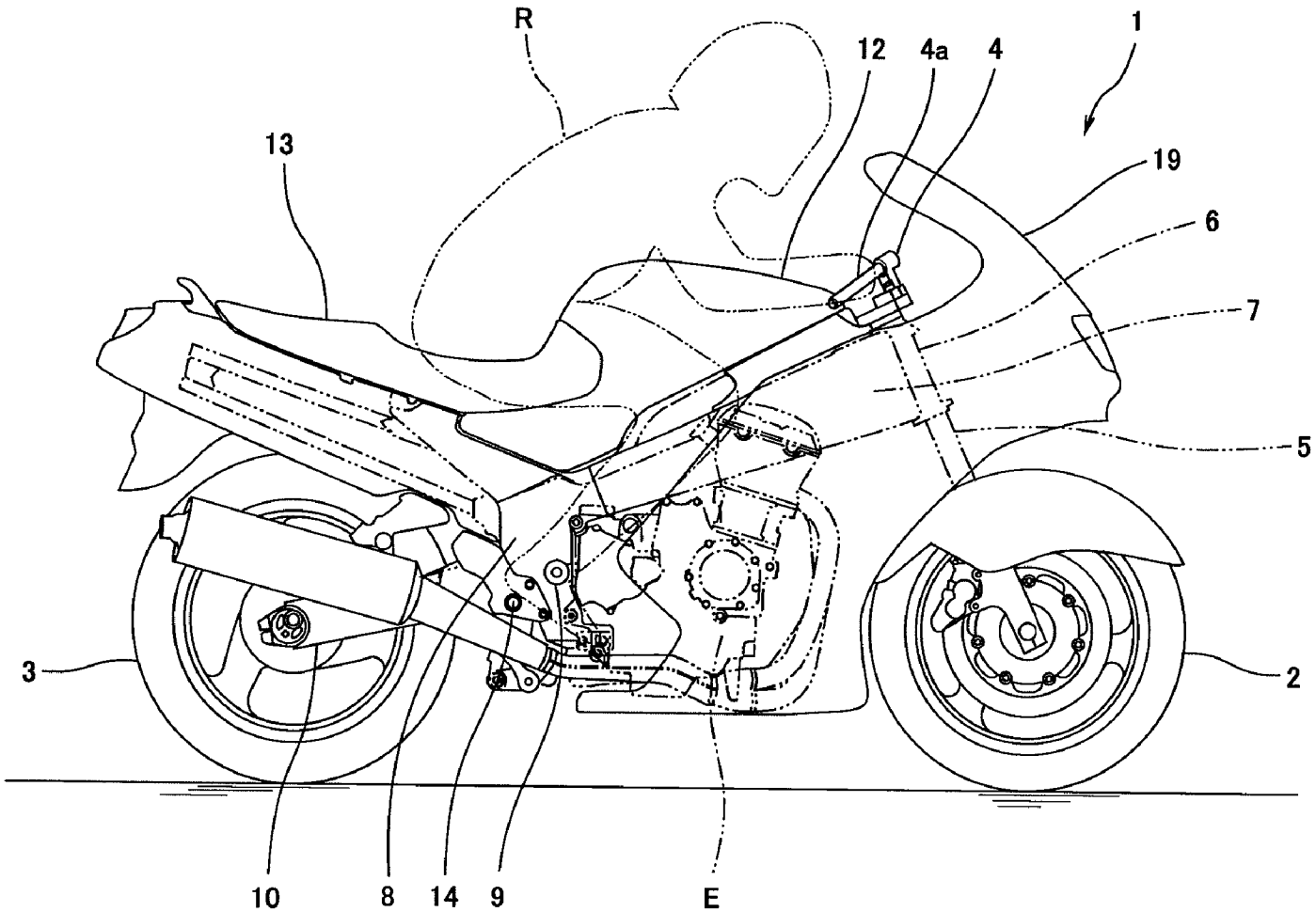
FIG. 1 is a right side view of a motorcycle including a lubricating system for a valve operating system according to a first embodiment of the present invention.

FIG. 1 is a right side view of a motorcycle 1 equipped with an engine E according to an embodiment of the present invention. Herein, directions are generally referenced from the perspective of a rider R mounting the motorcycle 1.

Turning now to FIG. 1, the motorcycle 1 includes a front wheel 2 and a rear wheel 3. The front wheel 2 is rotatably mounted to a lower portion of a front fork 5 extending substantially vertically. The front fork 5 is mounted on a steering shaft (not shown) by an upper bracket (not shown) attached to an upper end thereof, and an under bracket located below the upper bracket. The steering shaft is rotatably supported by a head pipe 6. A bar-type steering handle 4 extending in a rightward and leftward direction is attached to the upper bracket. When the rider R rotates the steering handle 4 clockwise or counterclockwise, the front wheel 2 is turned to a desired direction around the steering shaft.

A pair of right and left main frame members 7, forming a frame of a vehicle body of the motorcycle 1, extend rearward from the head pipe 6. Pivot frame members 8 extend downward from rear portions of the main frame members 7, respectively. A swing arm 10 is pivotally mounted at a front end portion thereof to a pivot 9 provided at each of the pivot frame members 8. The rear wheel 3 is rotatably mounted at a rear end portion of the swing arm 10.

A fuel tank 12 is disposed above the main frame members 7 and behind the steering handle 4. A straddle-type seat 13 is disposed behind the fuel tank 12. An engine E is mounted between and below the right and left main frame members 7. A driving power of the engine E is transmitted to the rear wheel 3 via a chain (not shown), causing the rear wheel 3 to rotate. Thereby, the driving power is applied to the motorcycle 1. A cowling 19, which is an integral member, is provided to cover a front portion of the motorcycle 1, i.e., the head pipe 6, a front portion of the main frame members 7, and side portions of the engine E. Straddling the seat 13, the rider R mounts the motorcycle 1. Gripping a grip 4*a* provided at an end portion of the steering handle 4 and putting the rider R's feet on steps 14 provided in the vicinity of a rear portion of the engine E, the rider R drives the motorcycle 1.

Figure 2:
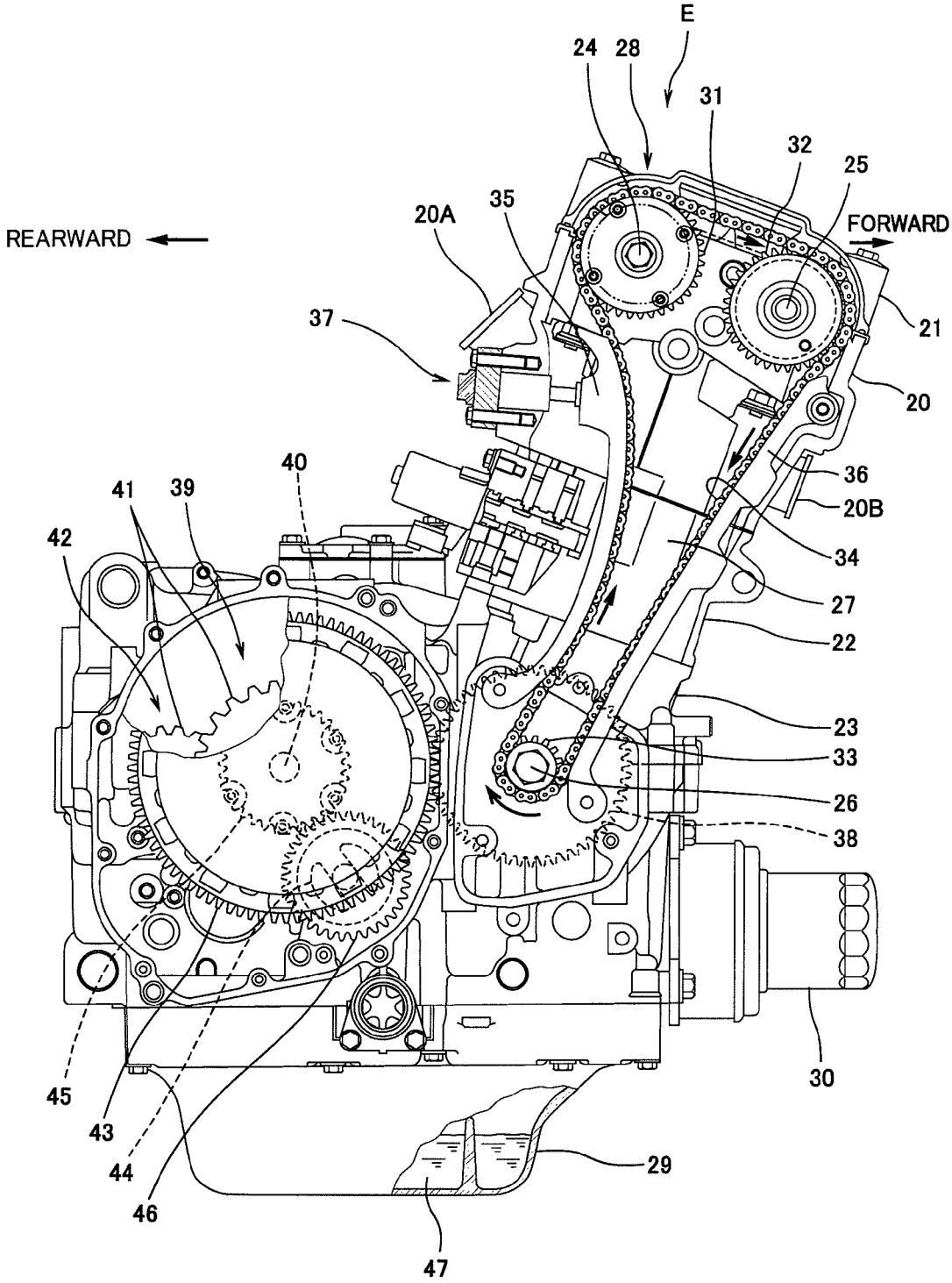
FIG. 2 is a right side view of the engine of FIG. 1, which is illustrated as being enlarged and partly in cross-section.

FIG. 2 is a right side view of the engine of FIG. 1, which is enlarged and partly in cross-section. As shown in FIG. 2, the engine E includes a cylinder head 20, a cylinder head cover 21, a cylinder block 22, and a crankcase 23. The engine E is an in-line four-cylinder double overhead camshaft (DOHC) engine. In a rear portion of the cylinder head 20, an intake port 20A is provided to open rearward and upward so as to correspond to each cylinder, while in a front portion of the cylinder head 20, an exhaust port 20B opens forward. In an upper portion of the cylinder head 20 of the engine E, a drive camshaft 24 for driving an intake valve and a drive camshaft 25 for driving an exhaust valve are disposed. The drive camshafts 24 and 25 are rotatably retained by a shaft support body 49 (see FIG. 3). The cylinder head cover 21 covers a shaft support body 49 from above, and is fastened to the cylinder head 20.

The cylinder block 22 is coupled to a lower portion of the cylinder head 20 and is configured to accommodate a piston (not shown) therein. The crankcase 23 is coupled to a lower portion of the cylinder block 22 and is configured to accommodate the crankshaft 26 extending in a width direction of the vehicle body of the motorcycle 1. In a right wall portion of the cylinder head 20, a right wall portion of the cylinder block 22, and a right wall portion of the crankcase 23, a chain tunnel 27 is formed to accommodate a rotation transmission system 28 configured to transmit a rotational driving force of the crankshaft 26 to the drive camshafts 24 and 25. An oil pan 29 is provided at a lower portion of the crankcase 23 and is configured to reserve oil (lubricating liquid) for lubricating or hydraulically powering engine components. An oil filter 30 is provided at a front portion of the crankcase 23 and serves to filter the oil suctioned from the oil pan 29.

The rotation transmission system 28 includes an intake cam sprocket 31, an exhaust cam sprocket 32, a crank sprocket 33, and a timing chain 34. To be specific, a right end portion of the drive camshaft 24 protrudes into the chain tunnel 27, and the intake cam sprocket 31 is provided at the right end portion of the drive camshaft 24. A right end portion of the drive camshaft 25 protrudes into the chain tunnel 27, and the exhaust cam sprocket 32 is provided at the right end portion of the drive camshaft 25. A right end portion of the crankshaft 26 protrudes into the chain tunnel 27, and the crank sprocket 33 is provided at the right end portion of the crankshaft 26.

The timing chain 34 is installed around the intake cam sprocket 31, the exhaust cam sprocket 32, and the crank sprocket 33. When the crank sprocket 33 rotates, the intake cam sprocket 31 and the exhaust cam sprocket 33 rotate in association with the rotation of the crank sprocket 33. Thus, the rotation transmission system 28 including the intake cam sprocket 31, the exhaust cam sprocket 32, the crank sprocket 33 and the timing chain 34 enables the rotational driving force of the crankshaft 26 to be transmitted to the drive camshafts 24 and 25. Therefore, the drive camshafts 24 and 25 rotate in synchronization with the crankshaft 26 in a cycle which is ½ of a rotational cycle of the crankshaft 26.

A movable chain guide 35 and a fixed chain guide 36 are provided in the interior of the chain tunnel 27. The fixed chain guide 36 extends vertically in front of the timing chain 34. The fixed chain guide 36 extends from a position in front of and in the vicinity of the crank sprocket 33 to a position below and in the vicinity of the exhaust cam sprocket 32. The fixed chain guide 36 is provided with a groove (not shown) formed in a rear portion thereof to extend along the longitudinal direction thereof. The groove enables the timing chain 34 to be supported from forward.

The movable chain guide 35 extends vertically behind the timing chain 34. The movable chain guide 35 is pivotally mounted at a lower end portion thereof to the right wall portion of the crankcase 23 at a position above and in the vicinity of the crank sprocket 33. An upper end portion of the movable chain guide 35 is positioned below and in the vicinity of the intake cam sprocket 31. A hydraulically-powered tensioner 37 is provided on a rear wall portion of the cylinder head 20. The movable chain guide 35 is subjected to at an upper portion thereof a forward force from the hydraulic tensioner 37. The movable chain guide 35 serves to support the timing chain 34 from behind and apply a suitable tension to the timing chain 34.

An output gear 38 is mounted on a right side portion of the crankshaft 26. The output gear 38 is rotatable integrally with the crankshaft 26 to output the rotation of the crankshaft 26. A transmission chamber 39 is formed in a rear portion of the crankcase 23. The transmission chamber 39 accommodates therein an input shaft 40 and an output shaft (not shown) extending substantially in parallel with the crankshaft 26. A plurality of gears 41 are mounted on the input shaft 40 and the output shaft and constitute a transmission 42. An input gear 43 is mounted on a right end portion of the input shaft 40. The input gear 43 is configured to mesh with the output gear 38 of the crankshaft 26 and is rotatable integrally with the input shaft 40. In this structure, an engine driving power of the engine E is transmitted from the crankshaft 26 to the input shaft 40 via the output gear 38 and the input gear 43. Then, the transmission 42 changes the rotational speed of the engine driving power and outputs the resulting driving power to the rear wheel 3 (FIG. 1).

The engine E includes a trochoidal rotor type oil pump 44. The oil pump 44 includes a pump driven gear 46 which is configured to mesh with a pump drive gear 45 mounted on the input shaft 40 of the transmission 42. The oil pump 44 is driven in association with the rotation of the crankshaft 26. The engine E is provided with lubricating or hydraulic oil passages to feed to the engine components the oil 47 suctioned up from the oil pan 29 by the oil pump 44.

Figure 3:
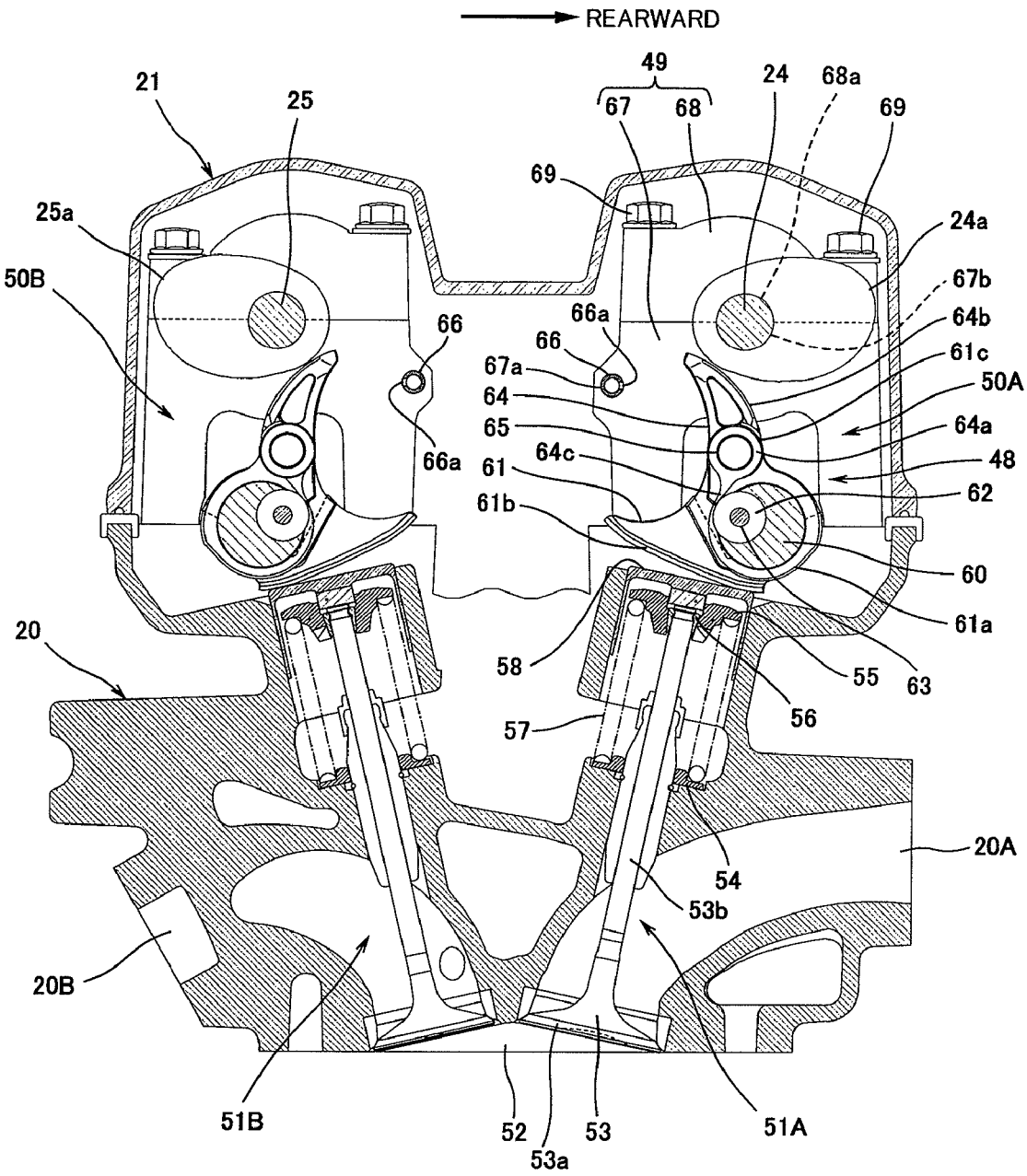
FIG. 3 is a cross-sectional view showing a valve operating system and other components in the engine of FIG. 1, which is illustrated as being enlarged.

FIG. 3 is an enlarged cross-sectional view of intake and exhaust valve operating systems 50A and 50B and others in the engine E of FIG. 1. As shown in FIG. 3, the cylinder head 20 is provided with an intake valve device 51A configured to open and close a combustion chamber 52 with respect to the intake port 20A, and an exhaust valve device 51B configured to open and close the combustion chamber 52 with respect to the exhaust port 20B. Four combustion chambers 52 are arranged in one line in a depth direction of FIG. 3. The intake valve operating system 50A causes the intake valve device 51A to open and close (reciprocate), while the exhaust valve operating system 50B causes the exhaust valve device 51B to open and close (reciprocate). Since the intake valve device 51A and the exhaust valve device 51B have substantially the same structure and the intake valve operating system 50A and the exhaust valve operating system 50B have substantially the same structure, the intake valve device 51A and the intake valve operating system 50A will be described.

The intake valve device 51A has a known structure, and includes a valve body 53 having a flange portion 53*a* configured to open and close the intake port 20A, and a stem portion 53*b* extending upward from the flange portion 53*a*. The stem portion 53*b* is provided with a groove at an upper end portion thereof. A cotter 56 is inserted into the groove of the stem portion 53*b*. A spring retainer 55 is mounted to the cotter 56. A spring seat 54 is mounted to an upper surface of the cylinder head 20. A valve spring 57 is mounted between the spring seat 54 and the spring retainer 55. The valve spring 57 applies an upward force to the valve body 53, and closes the intake port 20A. A tappet 58 is attached to an upper surface of the cotter 56.

The intake valve operating system 50A includes the drive camshaft 24 configured to operate in association with the rotation of the crankshaft 26 of the engine E, a drive cam 24*a* fixed to the drive camshaft 24, and a pivot cam device 48 configured to contact the drive cam 24*a* to transmit the movement of the drive cam 24*a* to the tappet 58 of the intake valve device 51A.

Figure 4:
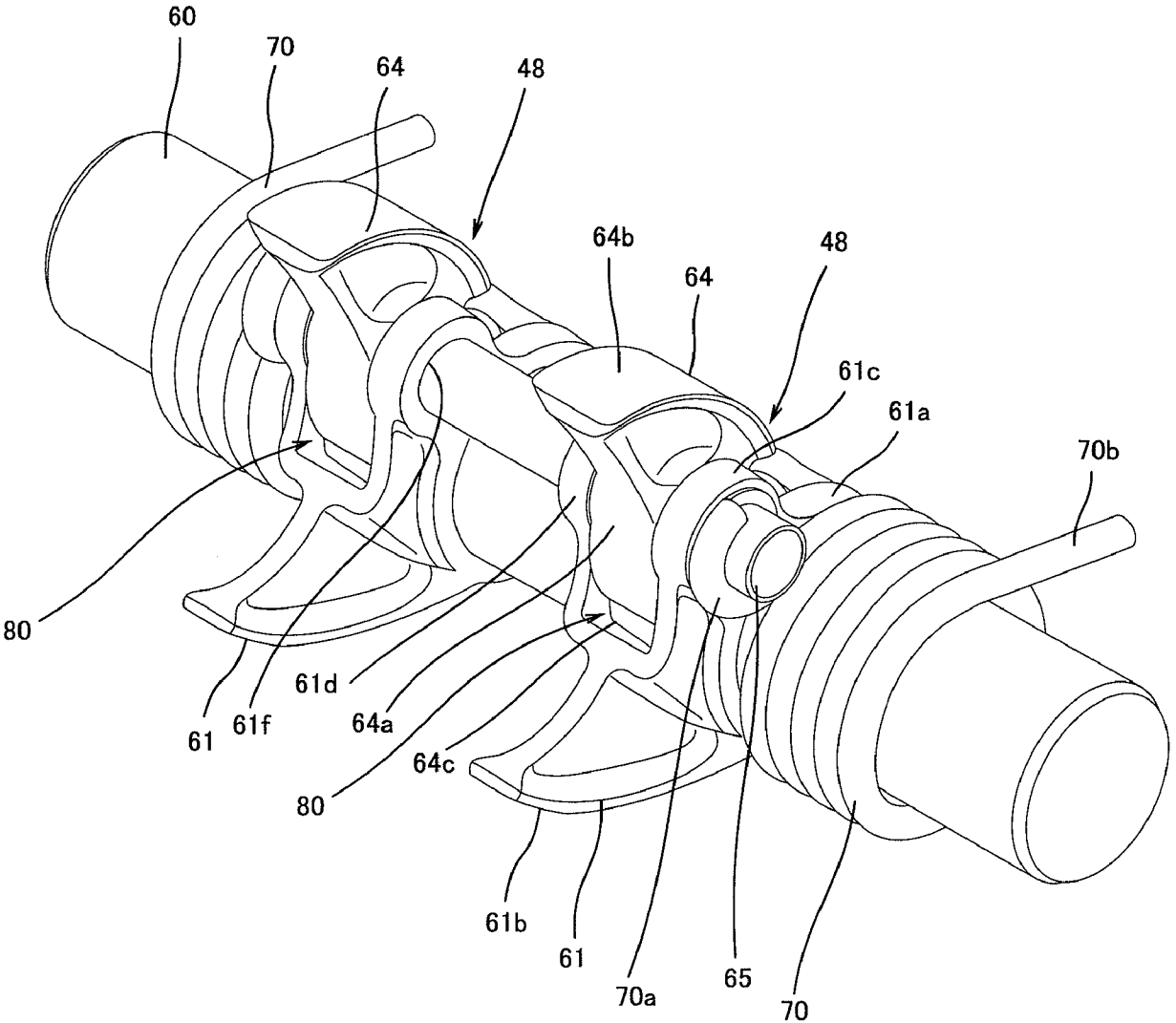
FIG. 4 is a perspective view showing major components of a pivot cam device of FIG. 3.
Figure 5:
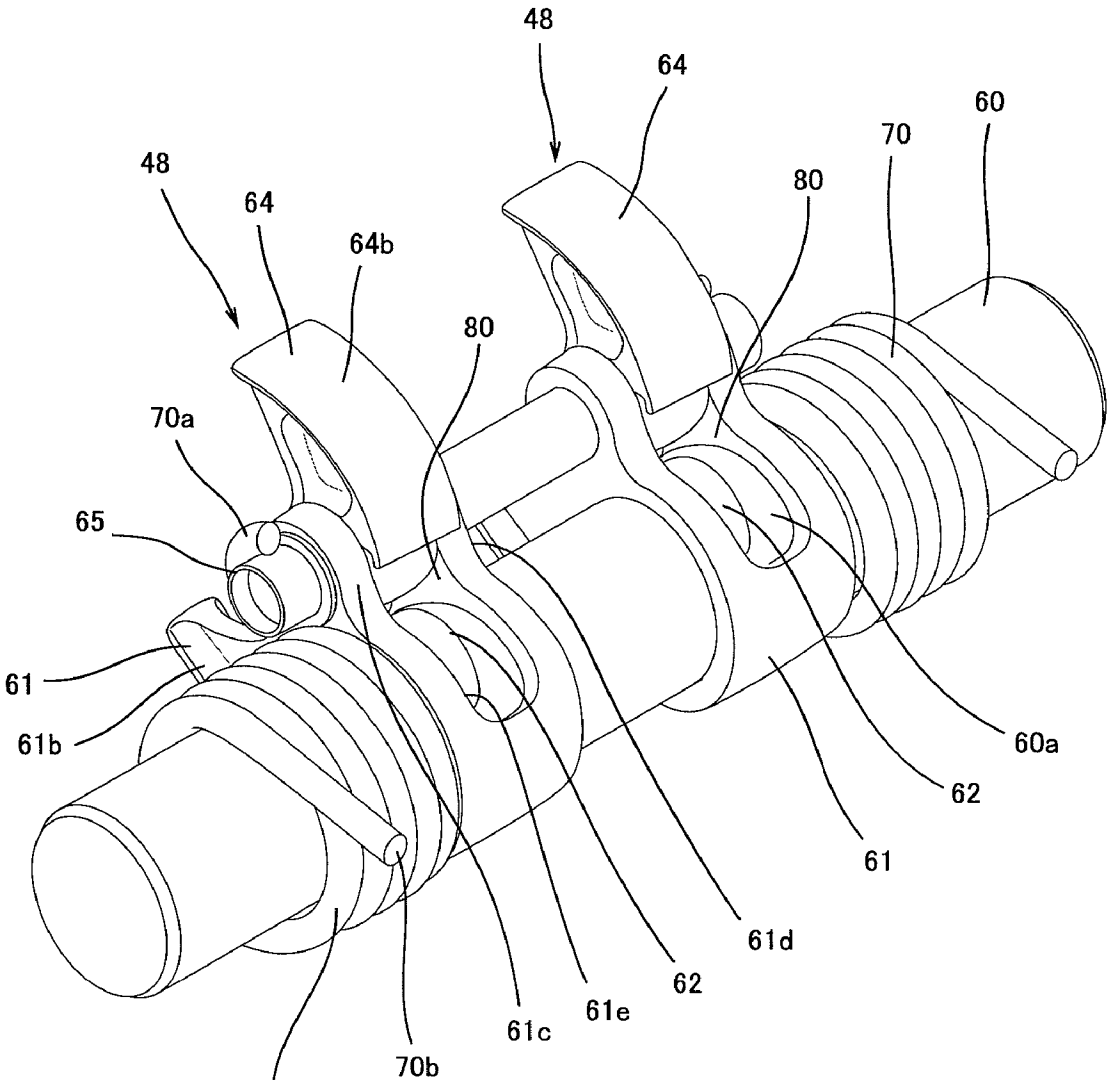
FIG. 5 is a perspective view of the pivot cam device of FIG. 4, as viewed from another angle.

FIG. 4 is a perspective view showing major components of the pivot cam device 48 of FIG. 3. FIG. 5 is a perspective view showing major components of the pivot cam device 48 of FIG. 4, as viewed from another angle. As shown in FIGS. 3 to 5, the pivot cam device 48 includes a driven member 64 configured to contact the drive cam 24*a*, a pivot member 61 which is mounted to the driven member 64 and is configured to press the tappet 58 of the intake valve device 51A, and a relative position changing device 80 configured to change relative positions of the driven member 64 and the pivot member 61. The relative position changing device 80 includes a control shaft 60 configured to pivotally support the pivot member 61, a coupling pin 65 coupling the driven member 64 to the pivot member 61 such that the driven member 64 is angularly displaceable with respect to the pivot member 61, a roller 62 (operation member) which is rotatably provided at a part of the control shaft 60 and is configured to support the driven member 64 against a force from the drive cam 24*a*, and a spring 70 configured to apply a force to cause the driven member 64 to move toward the drive cam 24*a*.

The pivot member 61 has a ring-shaped portion 61*a* which is rotatably and externally fitted to the control shaft 60 and a claw-shaped pivot portion 61*b* protruding toward the exhaust valve device 51B at a lower portion of the ring-shaped portion 61*a*. The pivot portion 61*b* has a substantially sector shape to form a pivot portion sliding surface of a substantially circular-arc shape and protrudes radially outward from the ring-shaped portion 61*a*. The pivot portion sliding surface extends along a flat plane perpendicular to an axis of the ring-shaped portion 61*a*. A distance between the pivot portion sliding surface and the center of the ring-shaped portion 61*a* changes in the direction from one end portion of the sliding surface to an opposite end portion of the sliding surface. A cut portion 61*e* is formed on an upper portion of the ring-shaped portion 61*a* so as to extend in a circumferential direction of ring-shaped portion 61*a*. A pair of pin support portions 61*c* and 61*d* are provided at both sides of the cut portion 61*e* in the ring-shaped portion 61*a* to be oriented upward and substantially toward the exhaust valve device 51B. A through hole 61*f* into which the coupling pin 65 is inserted is formed in the pin support portions 61*c* and 61*d*. Therefore, the pin support portions 61*c* and 61*d* are integrally fastened to the ring-shaped portion 61*a*, and the through hole 61*f* of the pin support portions 61*c* and 61*d* is positioned closer to the center of a virtual circle including the pivot portion sliding surface. The pin support portions 61*c* and 61*d* support the driven member 64 such that the driven member 64 is angularly displaceable around the axis of the through hole 61*f* by the coupling pin 65. The axis of the roller 62 is positioned eccentrically from the axis of the control shaft 60. The axis of the roller 62 partially protrudes radially outward from the control shaft 60. The roller 62 is loosely fitted in the cut portion 60*a* of the pivot member 61 so that the control shaft 60 is angularly displaceable around the center of the driven member 64.

The driven member 64 has a ring-shaped support portion 64*a* into which the coupling pin 65 is inserted and a claw-shaped driven portion 64*b* protruding upward and substantially toward the exhaust valve device 51B at the support portion 64*a*. The driven portion 64*b* has a substantially sector shape to form a driven portion sliding surface of a substantially circular-arc shape, and protrudes radially outward from the support portion 64*a*. The driven portion sliding surface extends along a flat plane perpendicular to the axis of the support portion 64*a*. A distance between the driven portion sliding surface and the center of the support portion 64*a* changes in the direction from one end portion of the sliding surface to an opposite end portion of the sliding surface.

A lever portion 64*c* protrudes downward from the support portion 64 and is configured to contact the roller 62. The lever portion 64*c* is disposed at an opposite side of the driven portion 64*b* with respect to the support portion 64*a*. A roller contact surface of the lever portion 64*c* and the driven portion sliding surface of the driven portion 64*b* extend substantially along a virtual circular-arc shape. The support portion 64*a* is disposed inside of the virtual circular-arc. The lever portion 64*c* is loosely fitted in a space of the cut portion 61*e* of the pivot member 61. When the lever portion 64*c* contacts the roller 62, further angular displacement of the driven member 64 around the pin support portions 61*c* and 61*d* is restricted. The coil-shaped spring 70 is externally fitted to the control shaft 60. One end portion 70*a* of the spring 70 is wound around the coupling pin 65, and an opposite end portion 70*b* thereof extends in a direction opposite to the direction in which the one end portion 70*a* extends. The opposite end portion 70*b* of the spring 70 is sandwiched and retained between a lower surface of a lower bearing concave portion 67*b* to be described later and the upper surface of the cylinder head 20.

A cut portion 60*a* is formed on the control shaft 60 in a position corresponding to the driven member 64. The roller 62 is disposed in the cut portion 60*a*. The roller 62 is rotatably supported by a shaft 63 axially penetrating through the inside of the control shaft 60. When the control shaft 60 rotates, the position of the roller 62 changes, changing a contact position of the lever portion 64*c* of the driven member 64 with respect to the roller 62. Thereby, the relative positions of the driven member 64 and the pivot member 61 are changed around the coupling pin 65. In other words, according to the angular displacement of the control shaft 60, the position around the axis of the control shaft 60 where the angular displacement of the driven member 64 is restricted is changed. On the other hand, irrespective of the angular displacement of the control shaft 60, the position around the axis of the control shaft 60 where the pivot member 61 is angularly displaced, is not changed. As a result, according to the angular displacement of the control shaft 60, a relative position relationship in the circumferential direction of the control shaft 60 between the pivot member 61 and the driven member 64 is changed.

As shown in FIG. 3, the shaft support body 49 is provided on the upper surface of the cylinder head 20 and is configured to rotatably support the drive camshaft 24. The shaft support body 49 includes a lower support member 67 protruding from the upper surface of the cylinder head 20, and an upper support member 68 mounted to the lower support member 67 from above by a bolt 69. The lower support member 67 has a lower bearing concave portion 67*b* having a semicircular cross-section. The upper support member 68 has an upper bearing concave portion 68*a* having a semicircular cross-section which is opposite to the lower bearing concave portion 67*b*. The drive camshaft 24 is rotatably inserted into a space which is defined by the lower bearing concave portion 67*b* and the upper bearing concave portion 68*b* and has a circular cross-section.

The lower support member 67 has an insertion hole 67*a* penetrating therethrough in an axial direction of the drive camshaft 24. An oil pipe (lubricating liquid pipe) 66 is inserted into the insertion hole 67*a*. That is, a pair of oil pipes 66 are provided between the intake valve operating system 50A and the exhaust valve operating system 50B. A plurality of outlets 66*a* open on a peripheral wall of each oil pipe 66 such that they are spaced apart from each other in an axial direction of each oil pipe 66. Through the outlets 66*a*, the oil flowing within the oil pipe 66 is ejected toward the intake valve operating system 50A.

The outlets 66*a* of the oil pipe 66 are located closer to a tip end portion of the claw-shaped driven portion 64*b* of the driven member 64 such that the outlets 66*a* are opposite to the tip end portion of the driven portion 64*b*. To be specific, the oil pipe 66 for the intake valve device 51A is disposed in a center space formed between the intake valve device 51A and the exhaust valve device 51B. The outlets 66*a* of the oil pipe 66 are oriented to face sliding surfaces which are the contact surfaces of the driven portion 64*b* of the driven member 64 and the drive cam 24*a* which are slidable relative to each other in at least a position of a movable range of the pivot cam device 48. In other words, the outlets 66*a* of the oil pipe 66 are oriented to face the sliding surfaces of the driven member 64 and the drive cam 24*a* at least in a period which is a part of one rotation of the drive cam 24*a*.

To be more specific, the outlets 66*a* are located above a lowermost position of the tip end portion of the driven portion 64*b* while the drive camshafts 24 and 25 are rotating once so that the oil ejected from the outlets 66*a* is applied to the driven portion 64*b* from above. The oil pipe 66 is located in close proximity to the drive cam 24*a* outside a moving range, i.e., a movement track of the drive cam 24*a* and the driven member 64 so that the oil ejected from the outlets 66*a* is easily applied to the sliding surfaces of the driven portion 64*b* and the drive cam 24*a*.

The oil pipe 66 is located between the drive camshaft 24 and the control shaft 60 in a vertical direction so that the oil is applied to both the drive cam 24*a* and the driven portion 64*b*. Furthermore, in a state where the drive cam 24*a* and a base end region of the sliding surface of the driven portion 64*b*, which is closer to the support portion 64*a*, are in contact with each other, the oil is ejected into a space defined by the sliding surface of the drive cam 24*a* and the sliding surface of the driven portion 64*b*. As should be appreciated, the oil pipe 66 serves as a guiding member to guide the oil to the sliding surfaces.

Figure 6:
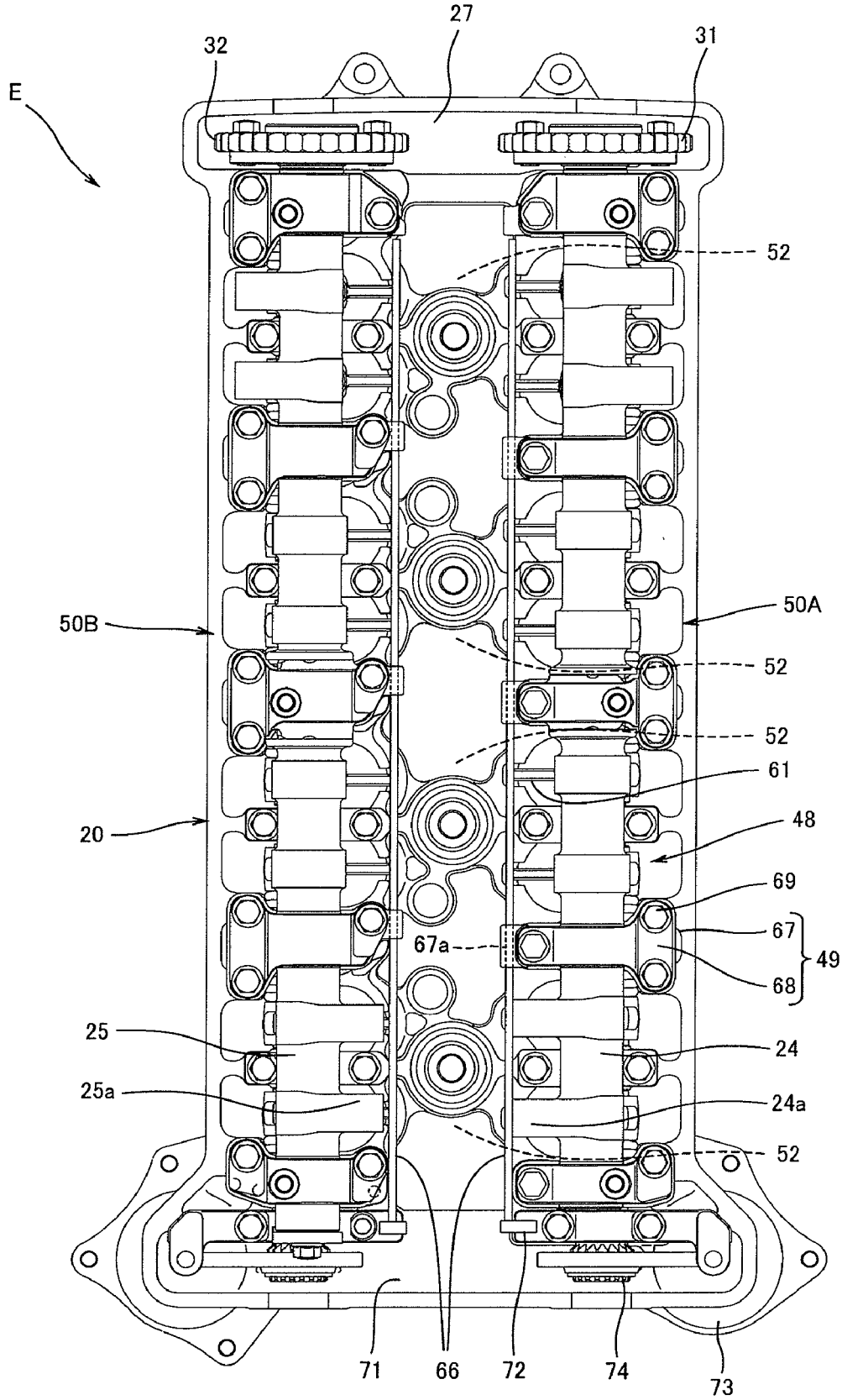
FIG. 6 is a plan view of the engine of FIG. 3, from which a head cover is removed.
Figure 7:
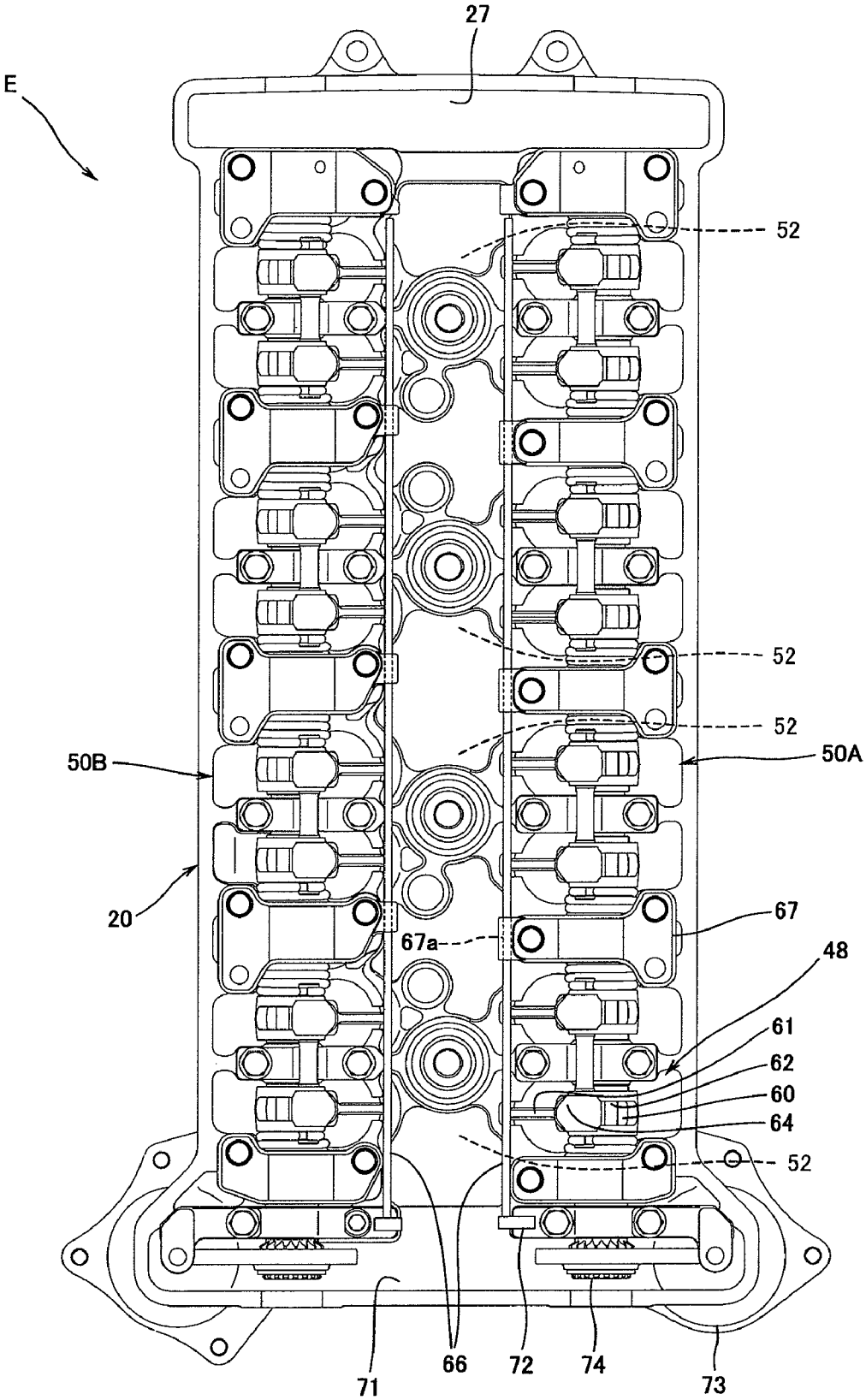
FIG. 7 is a plan view of the engine of FIG. 6, from which an upper support member and a drive camshaft are further removed.

FIG. 6 is a plan view showing the engine E of FIG. 3, from which the head cover 21 is removed. FIG. 7 is a plan view showing the engine E of FIG. 6, from which the upper support member 68 and the drive camshafts 24 and 25 are further removed. Turning to FIG. 6, the intake valve operating system 50A is aligned on one side relative to four combustion chambers 52 arranged in one line, while the exhaust valve operating system 50B is aligned on the other side relative to the four combustion chambers 52. That is, the intake valve operating system 50A and the exhaust valve operating system 50B are positioned at opposite sides with respect to the four combustion chambers 52 disposed therebetween. The drive camshafts 24 and 25 respectively extend in the direction in which the intake and exhaust valve operating systems 50A and 50B are aligned. The drive camshafts 24 and 25 are coupled to the cam sprockets 31 and 32 in the interior of the chain tunnel 27, respectively.

Turning to FIG. 7, the control shafts 60 respectively extend in the direction in which the intake and exhaust valve operating systems 50A and 50B are aligned. A gear chamber 71 is provided at an end portion of the engine E which is located far from the chain tunnel 27. A control gear 74 is disposed in the gear chamber 71 and is configured to mesh with the control shaft 60. The control gear 74 is driven by a motor 73 mounted to the engine E. That is, the motor 73 drives the control gear 74 to cause the control shaft 60 to rotate. The motor 73 is electronically controlled by an ECU (electronic control unit).

As shown in FIGS. 6 and 7, the pair of oil pipes 66 are arranged to extend in the center space between the intake valve operating system 50A and the exhaust valve operating system 50B in the direction in which the intake and exhaust valve operating systems 50A and 50B are aligned, i.e., along the axial direction of the drive camshafts 24 and 25 and the axial direction of the control shafts 60. One end portion of each oil pipe 66 is coupled to a pipe coupling portion 72 provided at the upper surface of the cylinder head 20. The pipe coupling portion 72 has an oil feed passage (not shown) to which the oil suctioned from the oil pan 29 by the oil pump 44 is fed, to feed the oil to the oil pipe 66.

Figure 8:
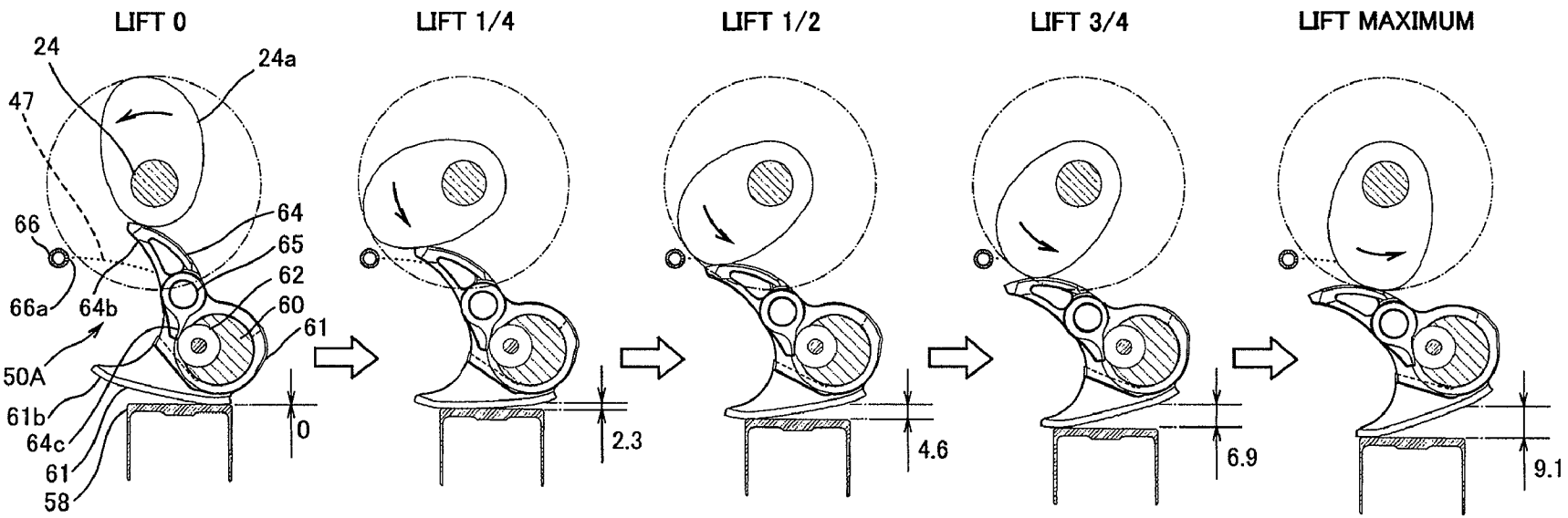
FIG. 8 is a view showing a normal operation of the valve operating system of FIG. 3.

Subsequently, an operation principle of the pivot cam device 48 will be described. FIG. 8 is a view showing a normal operation of the valve operating system 50 of FIG. 3. As shown in FIG. 8, at a time point when the tip end portion of the drive cam 24*a* is located at an upper limit position, i.e., a lift amount is zero, a force is applied to the driven member 64 from the spring 70 (see FIG. 4) via the coupling pin 65 so that the driven member 64 is pressed against the drive cam 24*a*. In this case, since the lever portion 64*c* of the driven member 64 is in contact with the roller 62, the rotation of the driven member 64 around the coupling pin 65 to cause the driven portion 64*b* to be closer to the pivot portion 61*b* is inhibited.

When the drive cam 24*a* rotates counterclockwise in FIG. 8, the driven member 64 is pressed down by the drive cam 24*a*. During this operation, since the driven member 64 is coupled to the pivot member 61 by the coupling pin 65, the pivot member 61 is pivoted around the control shaft 60 while causing the ring-shaped portion 61*a* to slide on the outer peripheral surface of the control shaft 60. Thereby, the pivot portion 61*a* of the pivot member 61 presses down the tappet 58, and the valve body 53 moves downward (lift), so that the intake port 20A is opened.

The oil pipe 66 is disposed so that the outlets 66*a* of the oil pipe 66 are oriented to face the sliding portions of the driven member 64 and the drive cam 24*a* in at least one position in the movable range of the pivot cam device 48 configured to operate as described above. In this structure, during the operation of the intake valve operating system 50A, the oil 47 ejected from the outlets 66*a* of the oil pipe 66 is directly applied to the sliding surfaces of the driven member 64 and the drive cam 24*a*. As a result, the oil 47 is sufficiently fed to the sliding surfaces so that an oil film thickness on the sliding surfaces is stably maintained. This enables improvement of durability against wear out, or the like of the intake valve operating system 50A.

Figure 9:
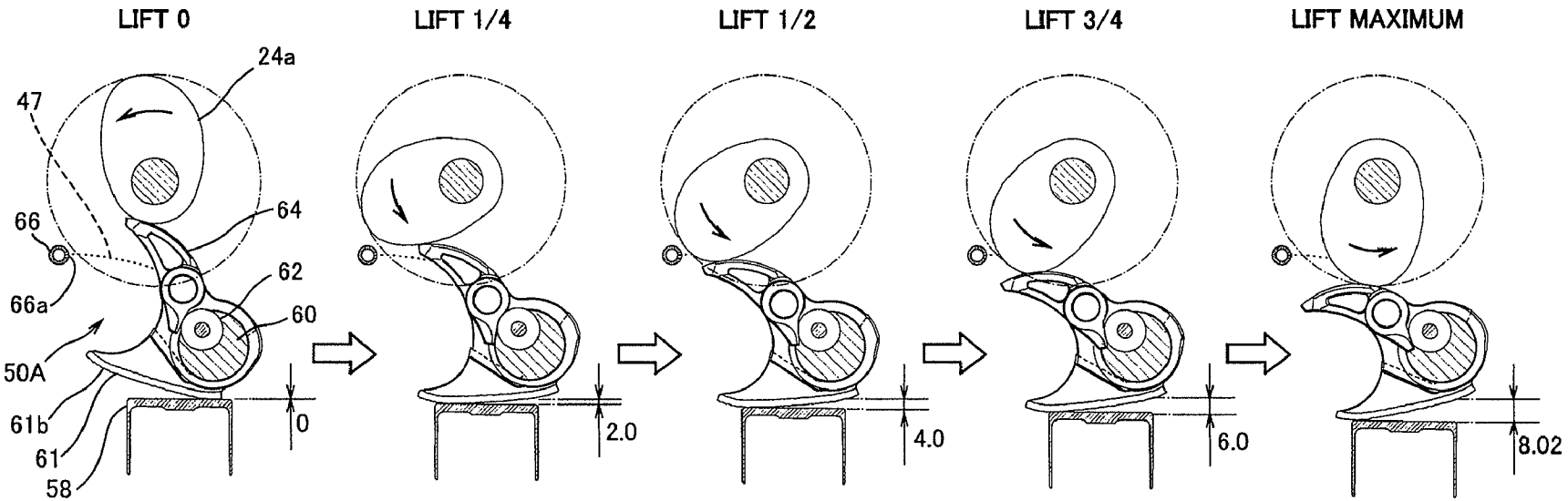
FIG. 9 is a view showing an operation of the valve operating system of FIG. 3, which occurs when a relative position is changed.

FIG. 9 is a view showing the operation of the intake valve operating system 50A of FIG. 3, occurring when its angle is changed. As shown in FIG. 9, when the control shaft 60 rotates counterclockwise in FIG. 9, the roller 62 moves according to the rotation. Thereby, a contact position of the lever portion 64*c* of the driven member 64 with respect to the roller 62 is changed, and an angle (relative position) formed between the driven member 64 and the pivot member 61 is changed. Therefore, the operation timing and lift amount of the valve body 53 which is pressed down via the tappet 58 by the pivot member 61 are changed. To be specific, an angle formed between the driven portion 64*b* and the pivot portion 61*b* is small, and the valve open time and lift amount of the valve body 53 are small. The oil pipe 66 is disposed so that the outlets 66*a* are oriented to face the sliding portions of the driven member 64 and the drive cam 24*a* in at least one position in the movable range of the pivot cam device 48 even when the angle of the intake valve operating system 50A is changed as shown in FIG. 9.

As described above, the variable valve timing operating systems (intake and exhaust valve operating systems) 50A and 50B are applied to the motorcycle 1 which is frequently driven in a high rotational range. It is desired that a sufficient amount of oil be fed to the sliding surfaces of the pivot cam device 48 and the drive cam 24*a*, as well as to the coupling regions of the components constituting the intake and exhaust valve operating systems 50A and 50B, and the oil film thickness on these regions be stably maintained. To this end, in the motorcycle 1 configured as described above, the oil 47 ejected from the outlets 66*a* of the oil pipe 66 is directly applied to the sliding surfaces of the driven member 64 and the drive cam 24*a* during the operation of the intake and exhaust valve operating systems 50A and 50B. Therefore, the oil 47 is sufficiently supplied to the sliding surfaces of the driven member 64 and the drive cam 24*a* so that durability against the wear out of the sliding surfaces is improved.

Since the oil pipe 66 is inserted into the insertion hole 67*a* provided in the shaft support body 49, a member for supporting the oil pipe 66 may be omitted. This makes it possible to reduce the number of components and achieve space saving. Further, since the oil pipe 66 is mounted to the lower support member 67 of the shaft support body 49, and a coupling state of the oil pipe 66 is maintained even if the upper support member 68 is detached from the lower support member 67, it is not necessary to attach and detach the oil pipe 66 when attaching and detaching the upper support member 68. This makes it easy to carry out maintenance.

Since the pair of oil pipes 66 are disposed in the center space formed between the line of the intake valve operating system 50A and the line of the exhaust valve operating system 50B, it is not necessary to provide a space used for disposing the oil pipes 66. As a result, the engine E is not increased in size. Furthermore, since the outlets 66*a* of the oil pipe 66 are located closer to the tip end portion of the driven member 64, which is displaceable in a maximum amount, the oil reaches the sliding surface of the driven member 64 in any position during the movement of the driven member 64 and lubricates the sliding surface stably even if the movement track of the oil ejected from the outlets 66*a* changes to some degree.

Since the roller 62 with which the lever portion 64*c* of the driven member 64 is configured to contact is rotatable around the shaft 63, a friction operation occurring between the driven member 64 and the roller 62 is suppressed. As a result, wear-out of the driven member 64 and the roller 62 is avoided, and hence, durability of them is improved. Furthermore, since the roller 62 is separate from the control shaft 60, an initial relative position relationship between the driven member 64 and the pivot member 61 is easily adjusted merely by changing the roller 62 with a roller having a different outer diameter.

Whereas in the intake and exhaust valve operating systems 50A and 50B of the present embodiment, the lift amount is variable, a phase angle or an operation angle may alternatively be variable. Whereas in the present embodiment, the oil pipe 66 having the outlets 66*a* is used as the ejecting device, a nozzle device, an injector, and others for ejecting the oil may alternatively be used. Whereas in the present embodiment, the motorcycle 1 is illustrated, the present invention is applicable to other vehicles. Furthermore, the lubricating system for the valve operating system of the present invention is not intended to be limited to the above described embodiments.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A lubricating system for a valve operating system, comprising:

a valve operating system configured to reciprocate a valve for substantially opening and closing a port connected to a combustion chamber of an engine; and an ejecting device in which a lubricating liquid for lubricating the valve operating system flows, the ejecting device being provided with an outlet from which the lubricating liquid is ejected, wherein the valve operating system includes:

a drive cam configured to operate in association with rotation of a crankshaft of the engine;

a driven member configured to contact the drive cam;

a pivot member which is attached to the driven member and is configured to transmit movement of the driven member to the valve; and a relative position changing device configured to change relative positions of the driven member and the pivot member;

wherein the outlet of the ejecting device is oriented to face sliding surfaces of the driven member and the drive cam at least in a period which is a part of one rotation of the drive cam.

2. The lubricating system for the valve operating system according to claim 1, further comprising:

a shaft support body configured to rotatably support a drive camshaft provided with the drive cam;

wherein the shaft support body is configured to support the ejecting device.

3. The lubricating system for the valve operating system according to claim 2, wherein the shaft support body includes a lower support member which is configured to protrude from an upper surface of a cylinder head of the engine and has a lower bearing concave portion, and an upper support member which is mounted to the lower support member from above and has an upper bearing concave portion opposite to the lower bearing concave portion;

wherein the drive camshaft is disposed between the lower bearing concave portion and the upper bearing concave portion; and wherein the ejecting device is supported by the lower support member.

4. The lubricating system for the valve operating system according to claim 1, wherein the ejecting device includes a lubricating liquid pipe having the outlet which opens in a position corresponding to the sliding surfaces of the driven member and the pivot member.

5. The lubricating system for the valve operating system according to claim 4, wherein the engine includes a plurality of combustion chambers arranged in a line shape, and intake ports respectively connected to the combustion chambers and exhaust ports respectively connected to the combustion chambers;

wherein the valve operating system includes a first valve operating system corresponding to the intake ports and a second valve operating system corresponding to the exhaust ports;

wherein the first valve operating system and the second valve operating system are respectively aligned at opposite sides with respect to the line of the combustion chambers interposed between the first and second valve operating systems such that the first and second valve operating systems extend substantially in parallel with the line of the combustion chambers; and wherein the lubricating liquid pipe is disposed between a line of the first valve operating system and a line of the second valve operating system so as to extend along the line of the first valve operating system and the line of the second valve operating system.

6. The lubricating system for the valve operating system according to claim 1, wherein the outlet of the ejecting device is located closer to a tip end portion of the driven member which is displaceable in a maximum amount.

7. The lubricating system for the valve operating system according to claim 6, wherein the valve is provided with a valve spring configured to apply a force in a direction to cause the port to be closed; and wherein the relative position changing device is provided with a spring configured to apply a force to cause the driven member to move toward the drive cam.

8. The lubricating system for the valve operating system according to claim 6, wherein the relative position changing device includes a control shaft configured to pivotally support the pivot member, a coupling pin configured to couple the driven member to the pivot member such that the driven member is angularly displaceable with respect to the pivot member, and an operation member which is rotatably provided at a part of the control shaft and is configured to support the driven member against a force applied from the drive cam; and wherein the control shaft is angularly displaceable to change a position of the operation member, causing a change in relative positions of the driven member and the pivot member around the coupling pin.

* * * * *